US006618904B1

(12) United States Patent
Nagy

(10) Patent No.: US 6,618,904 B1
(45) Date of Patent: Sep. 16, 2003

(54) SPRING LOADED VEHICLE HINGE MECHANISM

(75) Inventor: Louis A. Nagy, Scarborough (CA)

(73) Assignee: Van-Rob Stampings Inc., Aurora (CA)

( * ) Notice: Subject to any disclaimer, the term of this patent is extended or adjusted under 35 U.S.C. 154(b) by 144 days.

(21) Appl. No.: 09/668,474

(22) Filed: Sep. 25, 2000

(51) Int. Cl.[7] ..... E05D 15/32
(52) U.S. Cl. ..... 16/370; 16/389; 16/288
(58) Field of Search ..... 16/370, 289, 288, 16/286, 280; 49/386; 180/69.2, 69.21

(56) References Cited

U.S. PATENT DOCUMENTS 2,272,230 A * 2/1942 Van Voorhees ..... 16/306
4,382,312 A 5/1983 Liggett et al.
4,530,412 A * 7/1985 Sigety, Jr. ..... 16/260
5,062,182 A * 11/1991 Griffiths et al. ..... 16/302
5,339,494 A * 8/1994 Esau et al. ..... 16/233
5,435,406 A * 7/1995 Gaffoglio et al. ..... 180/69.21
5,544,388 A * 8/1996 Chiura ..... 16/289
5,557,829 A 9/1996 Schoen et al.
5,873,619 A 2/1999 Lewkoski et al.
6,230,364 B1 * 5/2001 Cheal ..... 16/286
6,397,434 B1 * 6/2002 Cheal et al. ..... 16/289

* cited by examiner

*Primary Examiner*—Gary Estremsky
*Assistant Examiner*—Mark Williams
(74) *Attorney, Agent, or Firm*—Riches, McKenzie & Herbert LLP

(57) ABSTRACT

In a multi-link hinge assembly for a rear deck lid or front hood for an automobile, a torsional coil spring is mounted with its coil coaxial to or proximate to a pivotal connection of the hinge assembly with arms of the coil spring engaging members of the hinge assembly to bias them for pivoting about the pivotal connection. The torsional coil spring provides enhanced "pop-up" of the lid or hood on initial unlocking and can reduce the need for or size of a primary biasing mechanism to assist in opening the lid or hood.

5 Claims, 6 Drawing Sheets

SPRING LOADED VEHICLE HINGE MECHANISM

SCOPE OF THE INVENTION

This invention relates to a multi-link hinge assembly for mounting a closure panel to a vehicle compartment and, more particularly, to a spring assisted four link bar hinge assembly for mounting a rear deck lid or a front hood to an automotive vehicle body.

BACKGROUND OF THE INVENTION

Multi-link hinge assemblies for mounting rear deck lids and front hoods in automotive vehicles are known as, for example, disclosed in U.S. Pat. No. 5,557,829 to Schoen et al, issued Sep. 24, 1996, the disclosure of which is incorporated herein. The weight of known deck lids and front hoods resist the opening of the hinge assembly with the lid or hood mounted thereon. Known hinge assemblies provide biasing mechanisms to assist in opening or closing the lid or hood so that the manual effort required by a user are minimal.

Strut cylinders have been used with multi-link hinges to assist in opening a lid or hood and to prevent slamming of the lid or hood on closing. A disadvantage of such strut cylinders is that they are expensive with the cost of the strut cylinders generally increasing with an increase in the forces they are to apply, and with typically stronger, more expensive strut cylinders providing better operation. Another disadvantage is that the strut cylinders frequently do not provide for initial movement of the lid or hood when the lid or hood is unlocked. The present inventor has appreciated that on being unlocked, it is desired that the lid or hood "pop-up", that is, open immediately to a partially open position so that a user can readily appreciate that the lid or hood is unlocked.

SUMMARY OF THE INVENTION

Accordingly, to at least partially overcome these disadvantages, the present invention provides a multi-link hinge assembly with a spring mounted between links of the hinge assembly to provide a spring assisted opening particularly with the spring being a torsional coil spring whose coil is mounted near a pivot point between links of the hinge assembly and which coil spring supplements the opening forces provided by a primary biasing mechanism, with the coil spring particularly assisting in initial movement of the hood from an unlocked position.

The present invention provides a multi-link hinge assembly for a rear deck lid or front hood for an automobile having a torsional coil spring mounted with its coil coaxial to or proximate to a pivotal connection of the hinge assembly with arms of the coil spring engaging members of the hinge assembly to bias them for pivoting about the pivotal connection. The torsional coil spring provides enhanced "pop-up" of the lid or hood or initial unlocking and can reduce the need for or size of a primary biasing mechanism to assist in opening the lid or hood.

It is an object of the present invention to provide a spring loaded hinge assembly for mounting a closure panel such as deck lid or bonnet hood to a vehicle body.

It is another object of the present invention to provide a torsional coil spring loaded hinge assembly for swingably mounting a rear deck lid or a front hood to an automotive vehicle compartment which is economical and at the same time capable of providing a pop-up swing up action to the lid or hood when it is unlocked.

Another object is to provide a multi-link hinge assembly for a rear deck lid of an automobile having a primary biasing mechanism to assist opening of the lid and, as a secondary biasing mechanism, a spring disposed between the link members near a pivotal connection of the link member.

With these and other objects in view, according to an embodiment of the present invention, there is provided a hinge assembly for swingably mounting a rear deck lid or a front hood to an automotive vehicle compartment comprising a lower bracket secured to an associated side structure of the vehicle in a generally horizontal position, an upper bracket secured to an underside of the lid or hood, a multi-link arrangement comprising a plurality of elongate link members interconnecting the lower bracket and the upper bracket for moving the upper bracket relative the lower bracket between open and closed positions, a primary spring means biasing the upper bracket to move towards the open position and substantially supporting the weight of the lid or hood in the open position, a secondary spring means biasing the upper bracket to move from the closed position towards the open position and whose spring force is maximum on initial movement of the upper bracket relative the lower bracket from the closed position towards the open position.

According to a further embodiment of the invention, there is provided a hinge assembly for mounting a closure panel to a vehicle compartment, comprising a lower bracket member adapted to be secured to a lateral side structure of the compartment, an upper bracket member adapted to be secured to an underside of the closure, a pair of link members pivotally connecting the lower and upper bracket members such that, when the closure panel swings from a generally horizontal closed position to an open position to access the compartment, both link members swing in a generally vertical plane about their pivots in a direction towards a first end of the lower bracket member, and when the closure panel swings back from the open position to the closed position, both link members swing in an opposite direction towards a second end of the lower bracket member, and biasing means loaded between the lower bracket member and at least one of the link members and urging the link members to swing about their pivots towards the first end of the lower bracket member which in turn urging the closure panel to swing open.

In another embodiment, the invention provides a hinge assembly for swingably mounting a rear deck lid or a front hood to an automotive vehicle compartment, comprising a lower bracket member having a front end and a rear end and secured to an associated side structure of the vehicle in a generally horizontal position, an upper bracket member having a front end and a rear end and secured to an underside of the lid or hood, a first link member having a first end and a second end, the first end of the first link member pivotally connected to the front end of the lower bracket member, and the second end of the first link member pivotally connected with the upper bracket member at a location between the front and rear ends of the upper bracket member, a second link member having a first end and a second end, the first end of the second link member pivotally connected to the rear end of the lower bracket member, and the second end of the second link member pivotally connected to the rear end of the upper bracket member, the first link member being longer than the second link member, arrangement of the link members and the upper and lower bracket members being such that when the upper bracket member swings from a generally horizontal closed position substantially parallel to the lower bracket member to an open position in which the front end of the upper bracket member is spaced farther from the lower bracket member than the rear end of the upper bracket member to access the compartment the second end of the second link member swings relative the lower bracket member in a generally vertical plane in a first direction and the second end of the first link member swings relative the lower bracket member in the same first direction, and when the upper bracket member swings back to the closed position, both the second ends of the first and second link members swing in an opposite second direction, a strut cylinder member having a first end and a second end, the first end of the cylinder member pivotally connected to the front end of the lower bracket member, and the second end of the cylinder member pivotally connected to the upper bracket member at a location between the front end of the upper bracket member and a point of pivotal connection of the second end of the first link member with the upper bracket member, the cylinder member assisting in swinging the first and second link members towards the open position, and a torsional coil spring with a central coil from which a first arm and a second arm extend tangentially, the coil being mounted to the lower bracket member proximate to a pivotal connection between the first end of the first link member and the front end of the lower bracket member with an axis of the coil parallel to the pivotal connection and with the first arm of the spring engaging with the lower bracket member and the second arm of the spring engaging with the first link member thereby urging the first link member to swing relative the lower bracket member in the first direction.

BRIEF DESCRIPTION OF THE DRAWINGS

These and other features, objects and advantages of the present invention will become apparent from the following description taken together with the accompanying drawings in which.

DETAILED DESCRIPTION OF THE DRAWINGS

Figure 1:
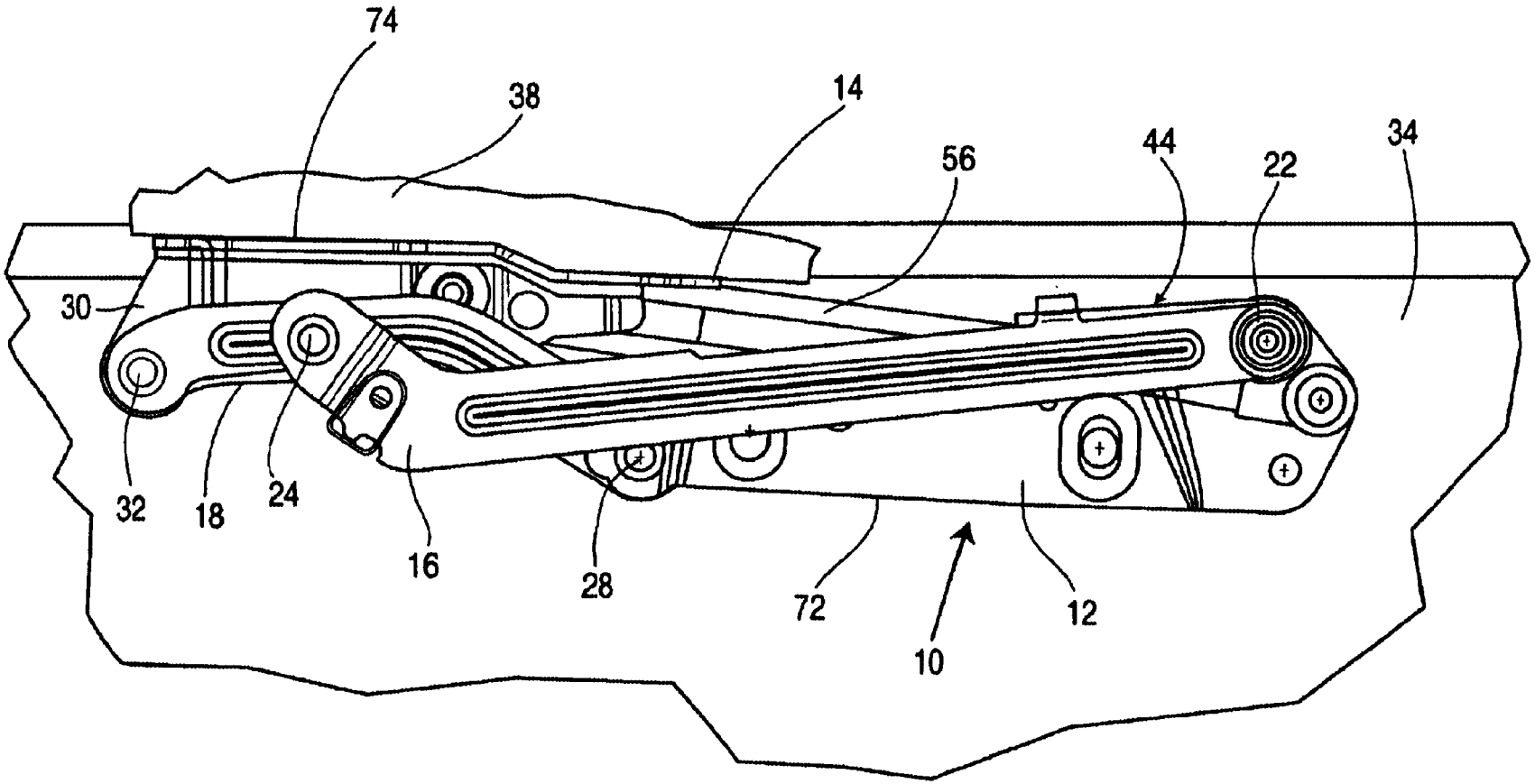
FIG. 1 is a schematic side view of a deck lid hinge assembly according to an embodiment of the present invention secured to a vehicle deck side structure, with the hinge assembly and the deck lid shown in a closed position.

FIGS. 1 to 7 show a first embodiment of a hinge assembly 10 according to the invention. The hinge assembly 10 comprises a lower bracket 12 and an upper bracket 14, and a pair of links 16 and 18 pivotally interconnecting the lower and upper brackets 12 and 14. Front link 16 is longer than rear link 18. A first end of front link 16 is pivotally connected to the front end 20 of lower bracket 12 through a pivot pin 22, and the other, second end of front link 16 is pivotally connected to the upper bracket 14 through pivot pin 24. A first end of rear link 18 is pivotally connected to the rear end 26 of the lower bracket 12 though a pivot pin 28 and the other, second end of rear link 18 is pivotally connected to the rear end 30 of the upper bracket 14 through a pivot pin 32. Lower bracket 12 is secured to a side panel designated generally 34 of a vehicle deck compartment by horizontal fasteners such as bolts (not shown) which are to pass through openings 36 in the lower bracket 12. The upper bracket 14 is secured to an underside of deck lid 38 by horizontal bolts (not shown) which are to pass through openings 40 in the upper bracket 14 and also by vertical bolts (not shown) provided to pass vertically through a longitudinal side flange 42 of the upper bracket 14.

The deck lid 38 is normally mounted to the side panels of a vehicle deck compartment on a pair of hinge assemblies, one attached to the left side panel and the other to the right side panel of the vehicle body. The hinge assemblies are identical mirror images of each other. Accordingly, only the right hand hinge assembly 10 has been shown and described herein. Although the hinge assembly shown and described herein is in relation to a deck lid, a similar hinge assembly can be used to mount a front hood to a vehicle body.

Operation of the hinge assembly 10 by the interaction of the lower bracket 12, upper bracket 14, front link 16 and rear link 18 is well known and to be understood as a simple manner of interactive pivoting of the rigid brackets and links about the pivot pins 22, 24, 28 and 32 , all of which are parallel. In referring to the elements of the hinge assembly, it is to be understood that in FIGS. 1 to 3 the right hand side is referred to as the "front" of the hinge assembly and the left hand side as the "rear". In a normal arrangement, each of the pivot pins 22, 24, 28 and 32 are horizontal and the front link 16, rear link 18 and upper bracket 14 each move within a vertical plane.

FIG. 1 shows a closed position with the deck lid 38 in a generally horizontal position. As seen, the upper bracket 14 is also generally horizontal and, in any event, substantially parallel the lower bracket 12. In this regard, as shown, an upper surface 74 of the upper bracket 14 and a lower surface 72 of the lower bracket 12 are parallel.

Figure 3:
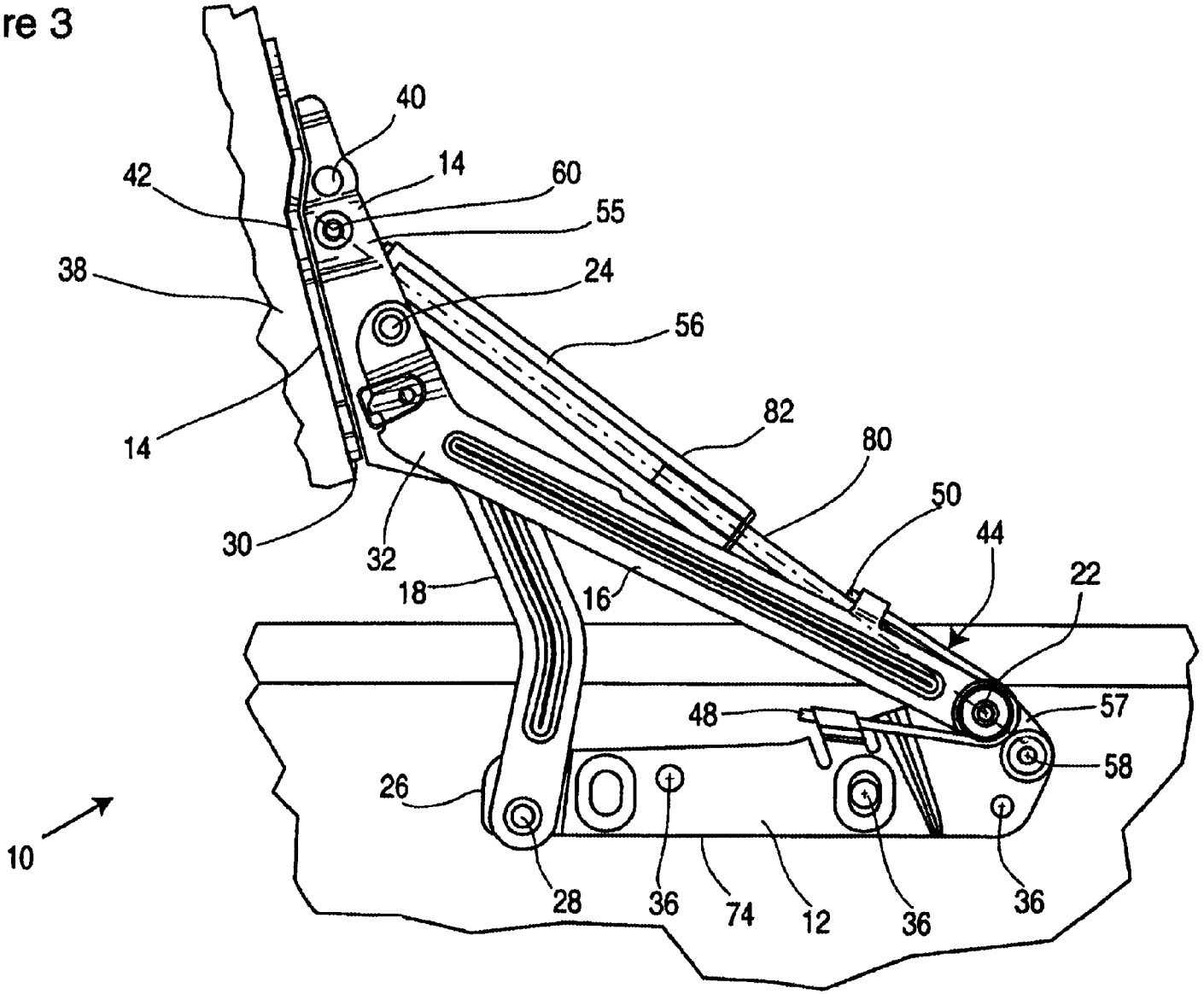
FIG. 3 is a view similar to FIGS. 1 and 2 best showing the hinge assembly and the deck lid of FIG. 1 in a fully open position.
Figure 4:
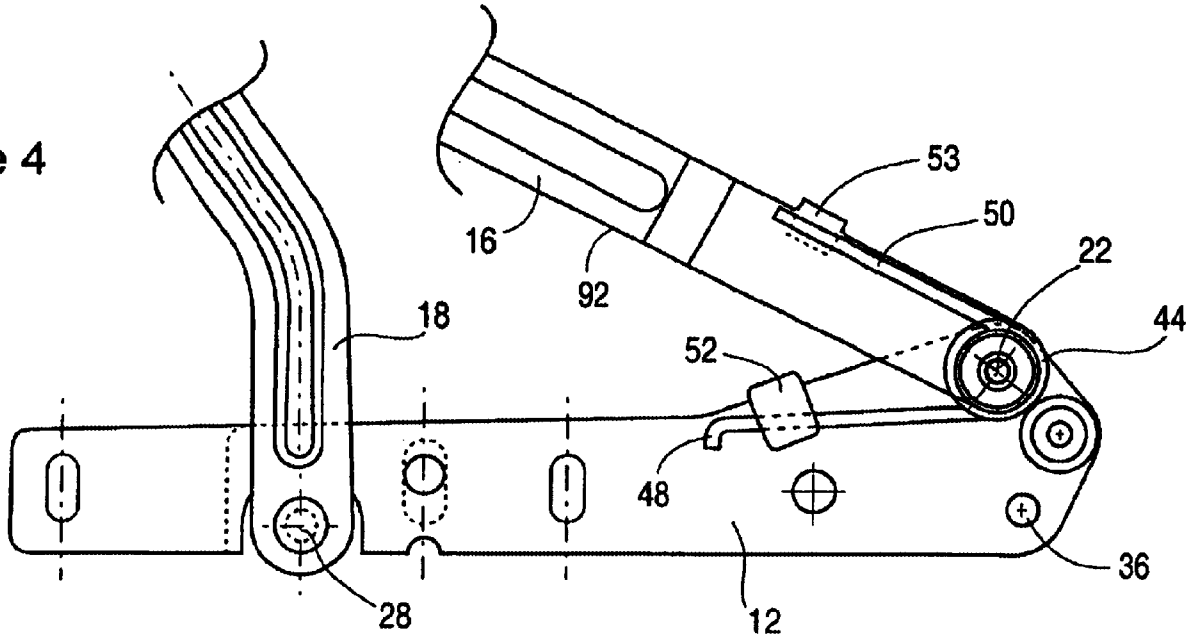
FIG. 4 is a side view of a lower bracket and part of its connecting links of a hinge assembly very similar to that shown in FIG. 2.

From the closed position of FIG. 1, the upper bracket 14 moves to the fully open position shown in Figure with both the front link 16 and the rear link 18 pivoting relative the lower bracket 12 in the same direction, that is, clockwise as seen in FIGS. 1 and 3. The upper bracket 14 in the fully open position of FIG. 3 is shown as having its upper surface 74 disposed at an angle in excess of 90 degrees relative the horizontal lower surface 72 of the lower bracket 12. Such movement of the upper bracket 14 occurs as is known with the relative pivoting of the front and rear links relative the lower bracket 12 with the distance between the first ends of the front and rear links where they are pivotally coupled to the lower bracket 12 different than the distance between the second ends of the front and rear links where they are pivotally coupled to the upper bracket 14.

Figure 2:
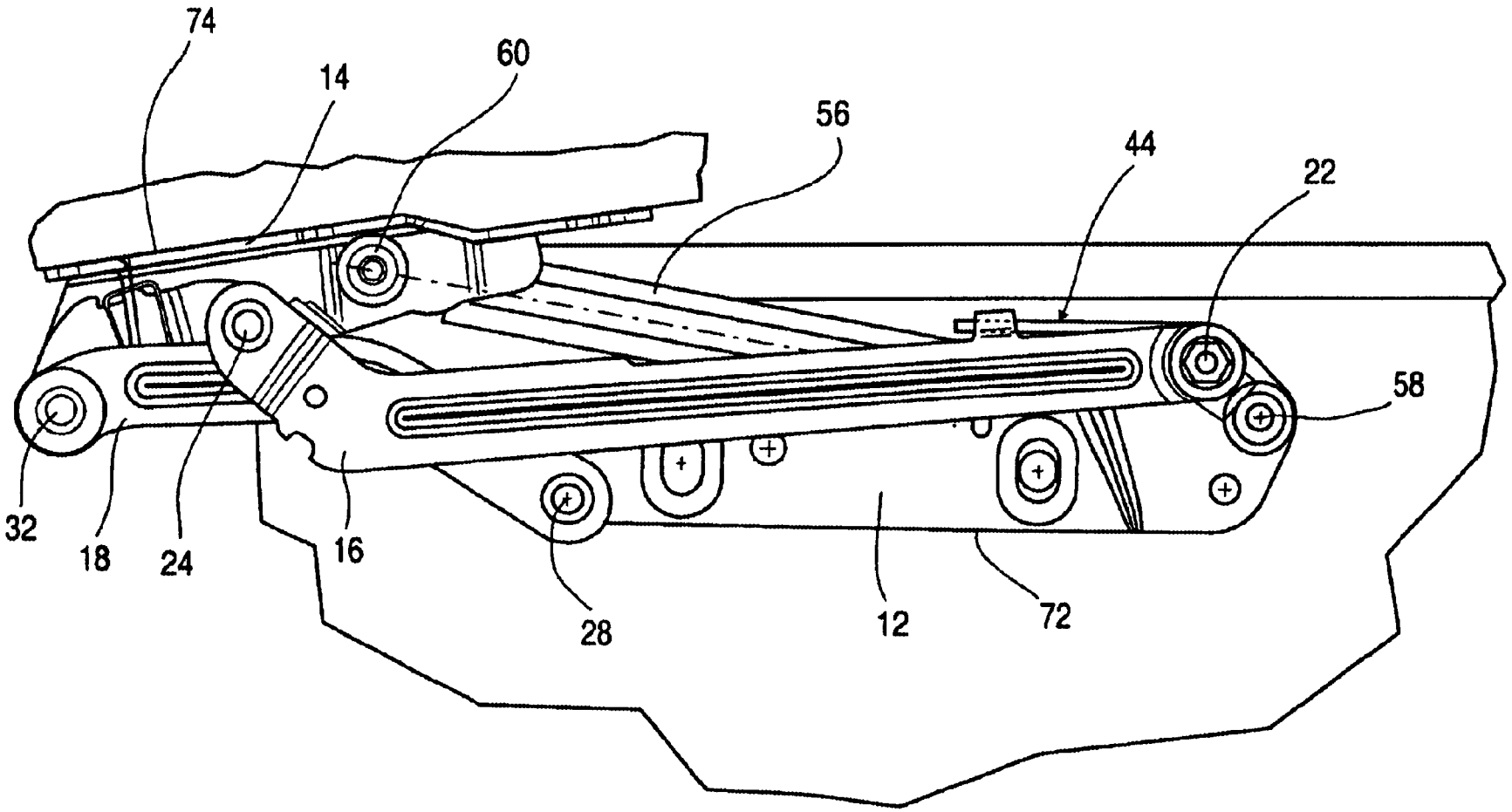
FIG. 2 is a view similar to FIG. 1 showing the hinge assembly and deck lid of FIG. 1 in a partially open "pop-up" position.

FIG. 2 shows the hinge assembly in a partially open position referred to as a "pop-up" position, which is between the closed and open positions. In FIG. 2, the upper surface 74 of upper bracket 14 is at an angle of about 15 degrees with the lower surface 72 of lower bracket 12.

As is known, a biasing mechanism is provided to assist in moving the rear deck from the closed position to the open position. The preferred embodiment of FIGS. 1 to 3 has as its biasing mechanism both a spring 44 and a gas strut cylinder 56.

Figure 5:
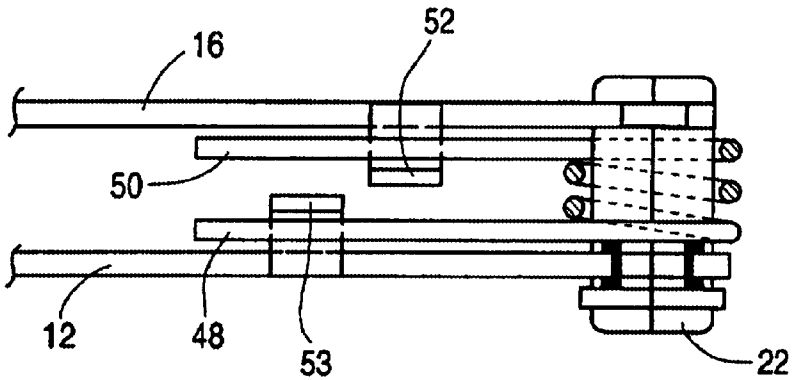
FIG. 5 is a top plan view of the hinge assembly shown in FIG. 4 showing the rear end of the lower bracket and the front link and with the coil spring therebetween partially sectioned.
Figure 6:
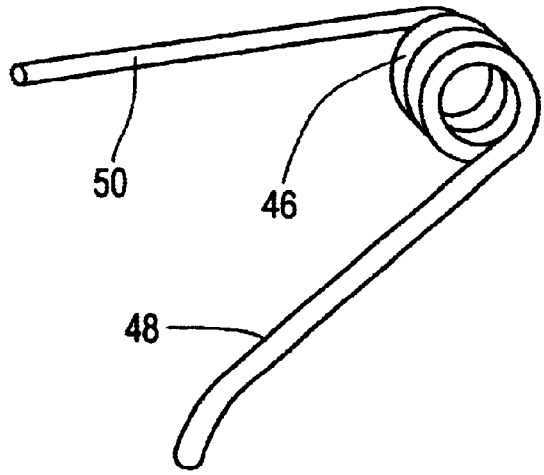
FIG. 6 is a perspective view of a torsional coil spring shown in FIG. 4.
Figure 7:
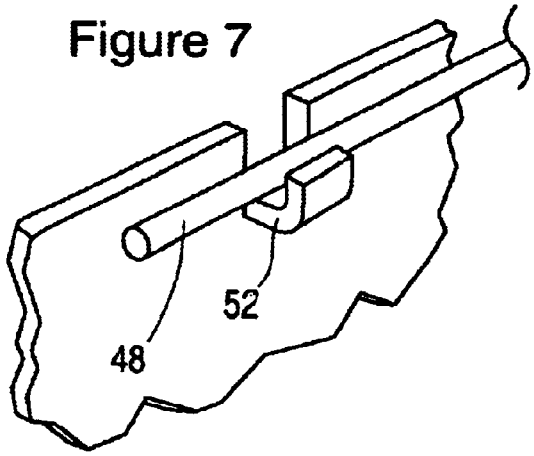
FIG. 7 is a partial pictorial view of a portion of the hinge assembly shown in FIG. 4 showing an arm of the spring engaging with the lower bracket of the hinge assembly.

The torsional coil spring 44 has a central coil 46 and tangentially extending arms 48 and 50 as best seen in FIG. 6. The coil 46 is mounted coaxially on the pivot pin 22 and located axially on the pivot pin 22 in between the lower bracket 12 and the front link 16 as seen in FIG. 5. Arm 48 of the spring engages with the lower bracket 12 and arm 50 thereof engages with the front link 16. A tab 52 provided on the lower bracket 12 as best shown in FIG. 7 locates and retains the arms 48 of the spring in engagement with the lower bracket 12. A similar tab 53 on the front link 16 retains arm 50 of the spring in engagement with the front link 16.

The spring 44 biases the front link 16 to pivot relative the lower bracket 12 about pivot pin 22 in a clockwise direction as shown and, therefore, toward the open position. The arms 48 and 50 of the spring 44 preferably continue to urge the link 16 and lower bracket 12 apart even in the fully open position so that the arms 48 and 50 will remain engaged on their respective tabs 52 and 53.

The torsional spring 44 is preferably selected such that the forces it applies are greatest when the hinge assembly is in the closed position and reduce as the hinge assembly moves from the fully open position toward the closed positions.

The strut cylinder 56 has a first end 55 pivotably connected to the lower bracket 12 on pivot pin 58 and a second end 57 pivotably connected to the upper bracket 14 on a pivot pin 60. Pivot pins 58 and 60 are parallel to the other pivot pins 22, 24, 28 and 32. The strut cylinder 56 provides a piston 80 movable within a cylinder 82 with the strut cylinder 56 shown acting to urge its ends 55 and 57 apart. The strut cylinder therefore urges the upper bracket 14 to move from the closed position to the open position. The strut cylinder 56 preferably also acts as a dampening mechanism to slow movement either to the open position or to the closed position.

In any position of the deck lid 38 between the open and closed positions, the relative weight of the deck lid 38 and the biasing forces developed by the biasing mechanism will determine whether the deck lid 38 will remain in any position and what forces are required to move the deck lid open or closed. The relative strengths of the biasing mechanism may be selected having regard to a number of criterion.

FIG. 1 shows a closed position with the deck lid 38 and the upper bracket 14 in a generally horizontal closed position with the upper bracket 14 substantially parallel to the lower bracket 12. A releasable latch mechanism (not shown) is provided to lock the deck lid in the closed position. When the latch mechanism is released, the deck lid is free to swing from the closed position of FIG. 1 to the open position of FIGS. 2 and 3. At a time when the latch mechanism is released, the upper bracket, along with the deck lid attached thereon, preferably moves from the closed position to the partially open "pop-up" position of FIG. 2 due to the biasing forces exerted thereon by the spring 44 and the strut cylinder 56 urging the hinge assembly toward the open position.

It is preferred that in the closed position the biasing forces move the deck lid from the closed position of FIG. 1 to the "pop-up" position of FIG. 2. The torsional coil spring 44 advantageously assists in moving the deck lid from the closed position of FIG. 1 quickly to the pop-up portion in FIG. 2 since the preferred torsional coil spring 44 applies a greatest force towards opening in the closed position. As well in the closed position, the line of action of the strut cylinder 56 is closest to the pivot pin 32 and typically does not provide as great forces towards opening as later in the opening movement and/or does not provide for as quick movement from the closed position to the pop-up position.

Preferably, the biasing forces are such that the deck lid assumes under merely the biasing forces either the "pop-up" position of FIG. 2 or the fully open position of FIG. 3. This is to say that when in the "pop-up" position, the deck lid will remain in the "pop-up" position until manual forces are applied to move the deck lid. Similarly, when in the fully open position, the deck lid will remain in the fully open position until manual forces are applied to close it.

In FIGS. 1 to 3, the biasing mechanism is provided as in combination the spring 44 and the strut cylinder 56. The strut cylinder 56 could be replaced with other biasing devices.

As seen in FIG. 1, the strut cylinder 56 is connected to the upper bracket 56 forward of the pivot pins 32 and 24 and urges the upper bracket 56 to pivot counterclockwise, since the strut cylinder 56 expands to bias its ends apart. In substitution of the expansion strut cylinder 56, a compression biasing device such as a spring or a cylinder which draws its ends together may be used, for example, with an end connected to the lower bracket 12 and the other end connected to an extension of the upper bracket 16 rearward beyond the pivot pin 32 as seen in FIG. 1. Such an arrangement is taught in U.S. Pat. No. 5,557,829.

Figure 9:
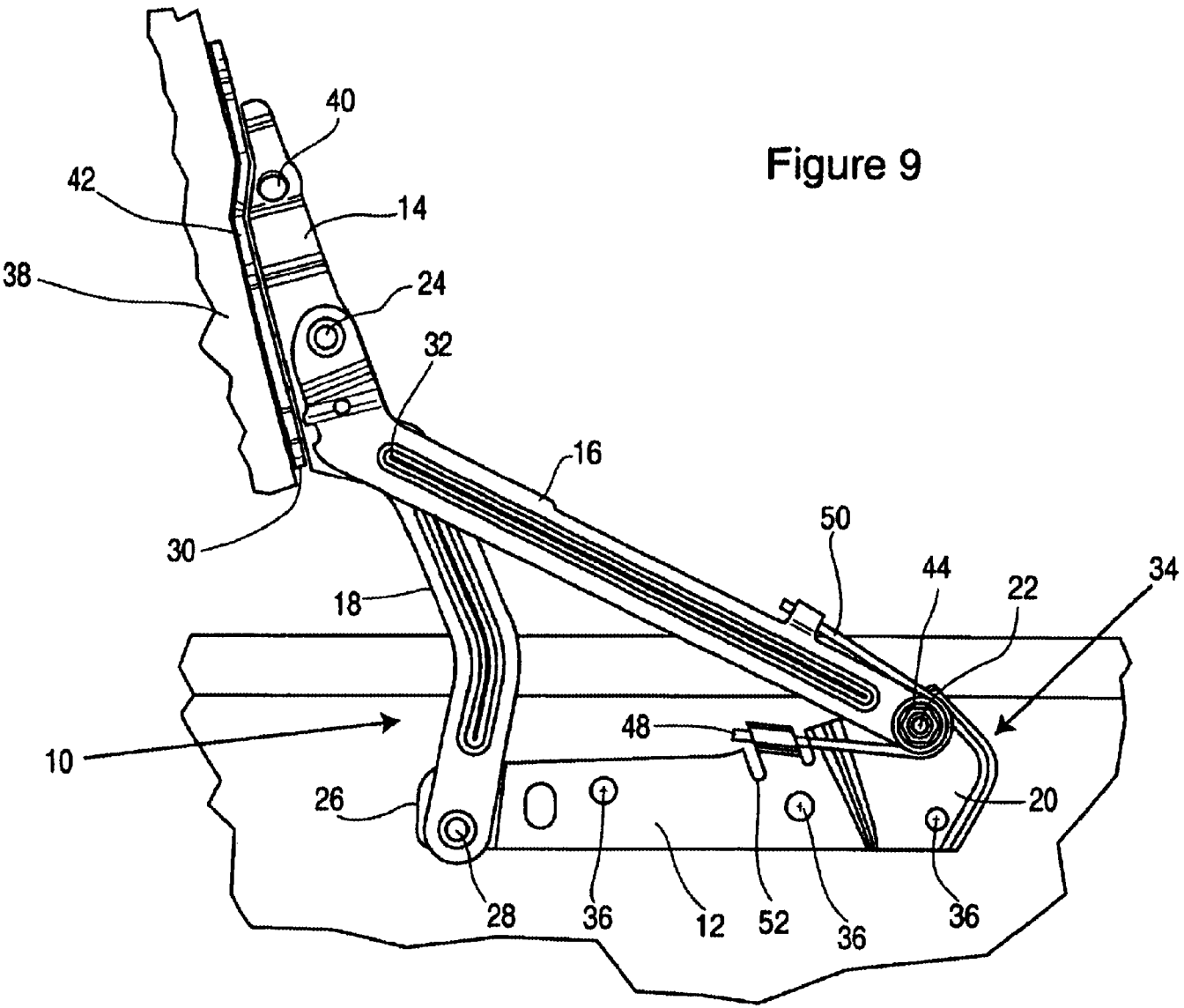
FIG. 9 is a view of an embodiment the same as that shown in FIG. 2 but with the gas strut cylinder removed.

FIG. 9 shows a hinge assembly identical to that of FIGS. 1 to 3, however, without the strut cylinder 56 and with the biasing mechanism comprising merely the spring 44. The spring 44 may by itself provide desired "pop-up" operation from a closed position and to assist in opening to the fully open position.

An advantage of providing the spring 44 in combination with another biasing device such as strut cylinder 56 is that having two biasing devices assist in developing the desired biasing forces which act on the hinge assembly at different positions. In particular while a strut cylinder 56 alone can provide useful operation, the addition of the spring 44 can significantly improve "pop-up" movement and as well can reduce the forces needed to be applied by the strut cylinder 56 and, therefore, costs.

The preferred embodiments show the strut cylinder 56 connected between the upper bracket 44 and lower bracket 12. It is to be appreciated that the strut cylinder 56 could be connected to the side panel 34 rather than the lower bracket 12 or to the deck lid 32 rather than upper bracket 14.

The preferred embodiments show a four link hinge arrangement with a coil spring on or near a pivotal connection of the hinge arrangement. The use of a coil spring on or near the pivotal connection of hinge arrangements having multiple links. for example, four, five or other number of links is within the scope of the invention.

Figure 8:
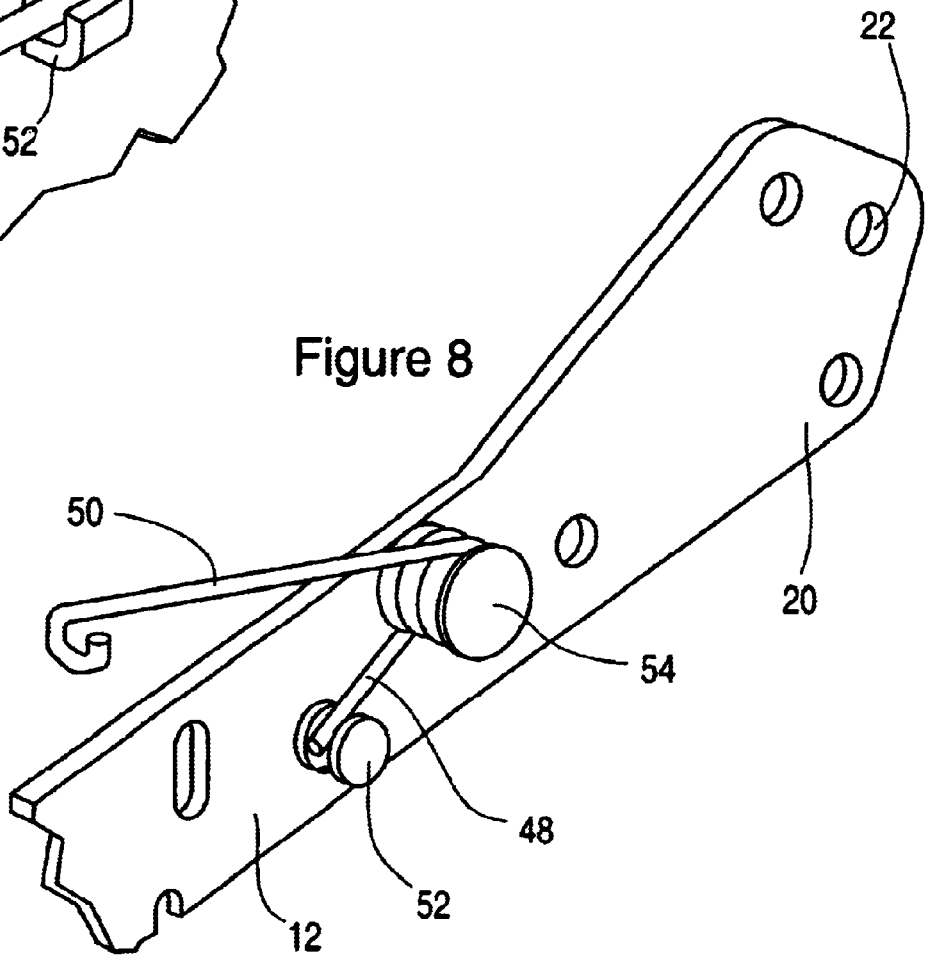
FIG. 8 is a partial pictorial view illustrating an alternative method of mounting a spring on the lower bracket according to another embodiment of the present invention.

The spring 44 has been shown in the embodiments of FIGS. 1 to 7 and describe herein to have its coil mounted coaxially about the pivot pin 22. It is possible to mount the coil at a suitable location proximal to the pivot pin 22 on the lower bracket 12 as shown in FIG. 8 in which the coil 46 is mounted on a bolt 54 secured on the lower bracket 12 near the pivot pin 22 but spaced therefrom. Bolt 54 has an enlarged head and the coil 56 is received coaxially on a shank of the bolt 54 between the lower bracket 12 and the head of the bolt with the axis of the coil 56 parallel to the axis of the pivot pin 22.

The arm 48 engages the lower bracket on a tab 52 formed by a rod-like protrusion with a groove to receive the arm 48.

The arm 50 carries a U-shaped bight 90 at its end to receive the lower edge 92 of the front link 16 for relative sliding therealong with pivoting of the front link 16.

While the coil spring 44 is shown mounted on or near to pivot pin 22, it is possible to mount the spring 44 on or near to any of the other three pivot pins 24, 28 and 32 with the spring arms 48 and 50 engaging with the respective bracket and link connected by the respective pivot pin. It is, however, preferred that the spring 44 be on or near the pivot pin that provides the greatest mechanical advantage on leverage towards opening of the hinge assembly. In the context of the embodiments shown, pivot pin 22 is preferred having regard to the juxtaposition of the brackets and links and since front link 16 is longer than rear link 18.

While the principles of the present invention in connection with the specific vehicle closure hinge assembly has been described in relation to certain preferred embodiments thereof, it is to be understood that the foregoing detailed description has been made by way of example only and not as a limitation as to the scope of the invention, and it will be apparent to those skilled in the art that the invention is susceptible to additional embodiments and that certain of the details described herein can be varied considerably without departing from the basic principles of the invention.

I claim:

1. A hinge assembly for swingably mounting a rear deck lid or a front hood to an automotive vehicle compartment, comprising:

a lower bracket member having a front end and a rear end and secured to an associated side structure of the vehicle in a generally horizontal position;

an upper bracket member having a front end and a rear end and secured to an underside of the lid or hood;

a first link member having a first end and a second end, the first end of the first link member pivotally connected to the front end of the lower bracket member to define a first pivotal connection, and the second end of the first link member pivotally connected with the upper bracket member at a location between the front and rear ends of the upper bracket member to define a second pivotal connection;

a second link member having a first end and a second end, the first end of the second link member pivotally connected to the rear end of the lower bracket member, and the second end of the second link member pivotally connected to the rear end of the upper bracket member;

the first link member being longer than the second link member;

arrangement of the link members and the upper and lower bracket members being such that when the upper bracket member swings from a generally horizontal closed position substantially parallel to the lower bracket member to a generally vertical open position in which the front end of the upper bracket member is spaced farther from the lower bracket member than the rear end of the upper bracket member to access the compartment, the first and second link members swing relative the lower bracket member in a generally vertical plane in a first direction, and when the upper bracket member swings back to the closed position, both the first and second link members swing in a second direction opposite to the first direction;

a primary spring means biasing the upper bracket member to move towards the open position and substantially supporting the lid or hood in the open position;

the primary spring means comprising a strut cylinder member having a first end and a second end, the first end of the cylinder member connected to the front end of the lower bracket member and the second end of the cylinder member connected to the upper bracket member at a location between the front end of the upper bracket member and the second pivotal connection;

a secondary spring means biasing the upper bracket member to move from the closed position toward the open position and whose spring force is maximum on initial movement of the upper bracket member relative the lower bracket member from the closed position toward the open position;

the secondary spring means comprising a torsional coil spring with a central coil from which a first arm and a second arm extend tangentially, the coil being mounted on or proximate to the first pivotal connection with an axis of the coil parallel to the first pivotal connection and with the first arm of the spring engaging with the lower bracket member and the second arm of the spring engaging with the first link member thereby urging the first link member to swing relative the lower bracket member in the first direction;

the spring urging the first link member to swing relative the lower bracket member in a first direction throughout the entire range of the movement of the upper bracket member from the closed position to the open position.

2. A hinge assembly as claimed in claim 1, wherein the coil is mounted to the lower bracket member proximate and parallel to the first pivotal connection.

3. A hinge assembly as claimed in claim 1, wherein the coil is received coaxially about a pivot pin making the first pivotal connection.

4. A hinge assembly for swingably mounting a rear deck lid or a front hood to an automotive vehicle compartment, comprising:

a lower bracket member having a front end and a rear end and secured to an associated side structure of the vehicle in a generally horizontal position;

an upper bracket member having a front end and a rear end and secured to an underside of the lid or hood;

a first link member having a first end and a second end, the first end of the first link member pivotally connected to the front end of the lower bracket member to define a first pivotal connection, and the second end of the first link member pivotally connected with the upper bracket member at a location between the front and rear ends of the upper bracket member to define a second pivotal connection;

a second link member having a first end and a second end, the first end of the second link member pivotally connected to the rear end of the lower bracket member, and the second end of the second link member pivotally connected to the rear end of the upper bracket member;

the first link member being longer than the second link member;

arrangement of the link members and the upper and lower bracket members being such that when the upper bracket member swings from a generally horizontal closed position substantially parallel to the lower bracket member to a generally vertical open position in which the front end of the upper bracket member is spaced farther from the lower bracket member than the rear end of the upper bracket member to access the compartment, the first and second link members swing relative the lower bracket member in a generally vertical plane in a first direction, and when the upper bracket member swings back to the closed position, both the first and second link members swing in a second direction opposite to the first direction;

a primary spring means biasing the upper bracket member to move towards the open position and substantially supporting the lid or hood in the open position;

the primary spring means comprising a strut cylinder member having a first end and a second end, the first end of the cylinder member connected to the front end of the lower bracket member and the second end of the cylinder member connected to the upper bracket member at a location between the front end of the upper bracket member and the second pivotal connection;

a secondary spring means biasing the upper bracket member to move from the closed position toward the open position and whose spring force is maximum on initial movement of the upper bracket member relative the lower bracket member from the closed position toward the open position;

the secondary spring means comprising a torsional coil spring with a central coil from which a first arm and a second arm extend tangentially, the coil being mounted on or proximate to the first pivotal connection with an axis of the coil parallel to the first pivotal connection and with the first arm of the spring engaging with the lower bracket member and the second arm of the spring engaging with the first link member thereby urging the first link member to swing relative the lower bracket member in the first direction;

wherein the coil is received coaxially about a pivot pin making the first pivotal connection.

5. A hinge assembly as claimed in claim 4, wherein the coil is mounted to the lower bracket member proximate and parallel to the first pivotal connection.

* * * * *